United States Patent [19]

Feibelman

[11] 3,958,788

[45] May 25, 1976

[54] DISPLAY CARD HOLDER ASSEMBLY

[75] Inventor: Hans J. Feibelman, Cranston, R.I.

[73] Assignee: A. & H. Mfg. Co., Providence, R.I.

[22] Filed: Sept. 23, 1974

[21] Appl. No.: 508,269

[52] U.S. Cl. ..... 248/214; 40/16.2; 211/123; 248/251; 248/307

[51] Int. Cl.[2] ..... A47H 1/00; A47H 1/14

[58] Field of Search ..... 40/10, 16, 16.2, 16.6, 40/16.4, 17, 18, 1, 124.1, 308.2 R, 12, 107, 128; 248/223–225, 214, 251, 307; 52/37; 211/44, 60, 65, 113, 123, 124; 35/24 A, 61, 63, 49, 54, 26

[56] References Cited

UNITED STATES PATENTS

| | | | |
|---|---|---|---|
| 2,206,522 | 7/1940 | Varon | 40/16.6 |
| 2,608,777 | 9/1952 | Schuler | 40/16.2 |
| 2,856,711 | 10/1958 | Hobbs | 40/16.4 |
| 2,895,241 | 7/1959 | Ferdinand et al. | 40/16.2 |
| 2,950,554 | 8/1960 | Foster | 40/16.2 |
| 3,238,656 | 3/1966 | Kanzelberger | 40/16.4 X |
| 3,539,204 | 11/1970 | Keller | 40/10 |
| 3,568,853 | 3/1971 | Feibelman | 211/113 |
| 3,590,754 | 7/1971 | Jakobsen | 108/161 |
| 3,684,229 | 8/1972 | Peter et al. | 248/225 X |

*Primary Examiner*—Roy D. Frazier
*Assistant Examiner*—Terrell P. Lewis
*Attorney, Agent, or Firm*—Salter & Michaelson

[57] ABSTRACT

A display card holder assembly for displaying articles, such as articles of jewelry, comprising a plastic card having a pair of flanges extending rearwardly therefrom, and a display bar specifically constructed so as to releasbly and slidably receive said card, said bar having a longitudinally extending slot therein receiving one of said card flanges, with the other flange frictionally engaging the bottom of said bar to maintain the card in depending relation with respect to said bar.

2 Claims, 5 Drawing Figures

DISPLAY CARD HOLDER ASSEMBLY

BACKGROUND AND SUMMARY OF THE INVENTION

It has been found desirable to provide a display card holder assembly comprising a specifically designed display card adapted to mountingly receive the article to be displayed, such as an article of jewelry, in combination with specifically designed holder means for the card wherein the card may be releasably and slidably received by the holder means for quick and easy attachment and detachment.

It is known in the art to provide display cards for jewelry and the like especially designed so as to be releasably received by holder means, as exemplified, for example, by applicant's prior U.S. Pat. No. 3,568,853 dated Mar. 9, 1971. Display assemblies of this general type have proven to be extremely desirable in the display of small articles, such as earrings or the like, since the cards, being constructed of plastic, are easily and inexpensively molded or extruded, and the display means which receive the cards are likewise simple and inexpensive to manufacture. In addition, the cards are quickly mountable on the display means by store personnel, and a rather voluminous number of cards may be mounted on a relatively small display rack.

One of the problems that is often encountered in connection with display assemblies of this general type, such as the display assembly disclosed in the aforesaid U.S. Pat. No. 3,568,853, is the problem of pilferage. Since the card is easily detachable from the display means, it follows that where the display is positioned in an area that is not always closely supervised by sales personnel, individual cards may be surreptitiously removed and pilfered.

In order to overcome this problem, the present invention provides a particular structural interrelation between the specially designed display card and the specially designed display bar on which the card is mounted. Although in the present invention, as in applicant's prior U.S. Pat. No. 3,568,853, the card is adapted to be snap-mounted on the bar and likewise detachable therefrom, the mounting, and more particularly the detachment, is not so obvious to the casual customer. Expressed differently, although one who is intimately familiar with the attachment and detachment of the card to the display bar in the present invention may quickly and easily manipulate the card to effect the desired attachment and, more importantly, the desired detachment, one not so familiar with the display assembly would not readily be aware of the quick-detachment capability of the card.

Although the card of the present invention has been specifically designed to cooperate with a specifically constructed display bar, the mounting means on the card are so constructed as to permit the card also to be clipped on to a conventional round or square rod.

Other objects, features and advantages of the invention will become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
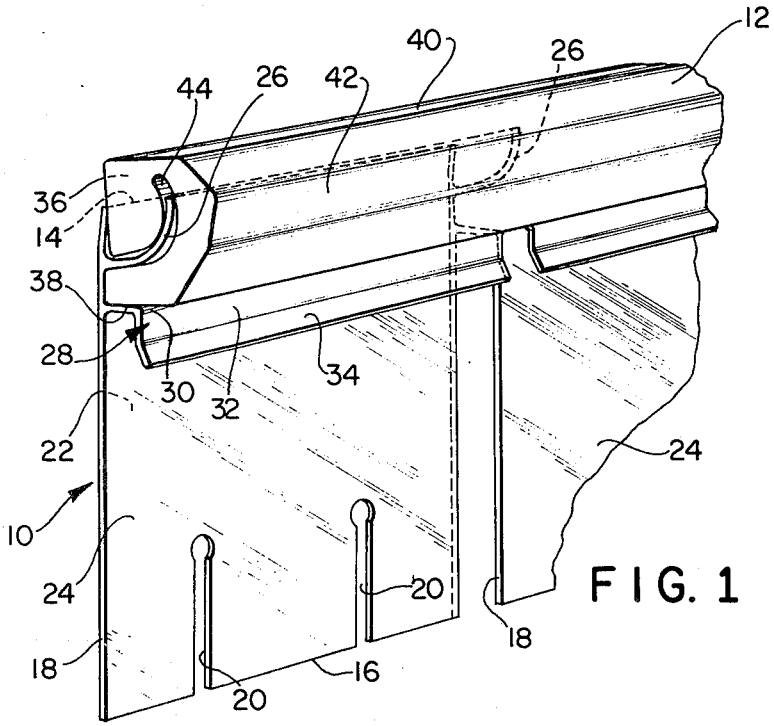
FIG. 1 is a fragmentary perspective view showing one form of my invention.

Referring now to the drawings, and more particularly to FIG. 1, there is shown an assembly comprising display card 10 and holder 12 which is in the form of an elongated bar. It will be understood that the horizontally extending bar 12 forms a part of an overall display rack, not shown. In other words, any conventional display rack comprising one or more upright stanchions may be provided, said upright stanchions having horizontally extending therefrom the bars 12, whereby each display unit may comprise a plurality of the elongated bars 12.

The card 10 is preferably of a flat, rectangular configuration having top edge 14, bottom edge 16, and vertically disposed side edges 18. Card 10 is preferably of a plastic construction and is adapted to be manufactured either by molding or extrusion, preferably the latter, it being understood that, if extruded, the cards are then cut to their desired size. The card 10 is preferably transparent, although not necessarily so, and is constructed of any plastic material that lends itself to the aforesaid manufacturing techniques, the only requirement being that the plastic embody some degree of flexibility. Any suitable means, such as grooves 20, may be provided in the card for receiving the articles to be displayed, it being understood that means such as grooves 20 are provided for receiving earrings or the like. Since the specific means for attaching the articles to be display to the card form no part of the present invention, no further description of same is deemed to be necessary.

As will be apparent from FIG. 1, the front surface 22 of card 10 constitutes a smooth, substantially planar surface, it being understood that the articles to be displayed will be mounted on said front surface. Rear surface 24 of the card 10 is provided with a first rearwardly extending flange 26 and a second rearwardly extending flange 28. Both the flanges 26 and 28 are integrally formed, and both preferably extend transversely of the back of card 10 from side edge to side edge thereof. As will be noted, the flange 26 is located adjacent to but spaced somewhat below top edge 14 of the card and extends rearwardly therefrom and then curves gently upward. Flange 28 is spaced somewhat below flange 26 in generally parallel disposition thereto and comprises a rearwardly extending portion 30, downwardly extending portion 32 terminating in an outwardly flared lip 34.

Bar 12, which also is preferably of plastic construction and specifically of a material that lends itself to extrusion, such as styrene, comprises a substantially flat front surface 36, bottom surface 38, top surface 40, and rear wall 42 of any suitable and desired configuration. Extending longitudinally of bar 12 is a slot 44, which slot extends rearwardly from front surface 36 thereof and then gently curved upwardly to generally correspond to the configuration of aforesaid flange 26.

Slot 44 extends transversely of bar 12 and is adapted to snap-receive therein the flange 26. At the same time, the spacing between portion 30 of flange 28 and the bottom of flange 26 generally corresponds to the spacing between the front edge of slot 44 and the bottom 38 of bar 12, whereby when flange 26 is resiliently received within slot 44, portion 30 of flange 28 grippingly engages bottom surface 38 of bar 12 to maintain the card 10 in abutting relation with the front surface of bar 12, with the major portion of said card depending downwardly from said bar, as clearly illustrated in FIG. 1. It will be understood that by properly manipulating the card 10, it may be snap-mounted on the bar 12; and likewise the card 10 may be snap-detached from the bar 12; although the capability of such quick-detachment would not be obvious to one not familiar with the assembly.

It will be obvious that the display bar 12 will normally be of a sufficient length so as to receive a plurality of cards 10 in side-by-side relation; and it will further be obvious that the cards 10, when mounted on bar 12, are slidably movable with respect thereto. If the bar 10 is exposed at one of its ends, as illustrated in FIG. 1, then the cards 10 may also be slidably inserted onto the bar, rather than snapped thereon. Where, however, the bar 12 extends between a pair of upright stanchions and hence has no exposed end, it obviously will be necessary to snap-mount the cards into display position. It will be understood that the resilience of the plastic material of which card 10 is constructed permits the aforesaid snap mounting, and it will further be understood that flanges 26 and 28 combine to grip or clamp the lower portion of bar 12 so as to resiliently maintain the card 10 properly positioned, as illustrated in FIG. 1.

Figure 2:
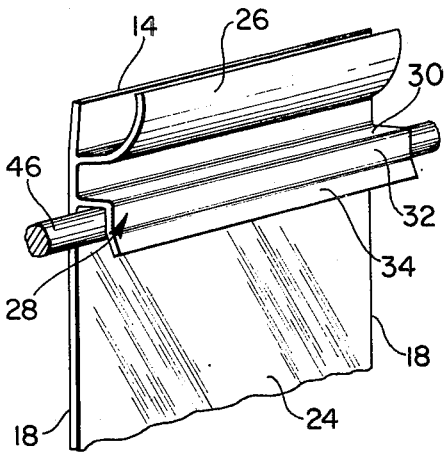
FIG. 2 is a fragmentary perspective view showing the card of FIG. 1 mounted on a conventional rod.

In the event that a display rack having the specially designed bars 12 is not available, flange 28 may clampingly receive a conventional round rod 46 to conventionally mount the card, as illustrated in FIG. 2. It will be obvious that flared lip 34 functions to facilitate entry of rod 46 into gripping relation with flange 28.

Figure 3:
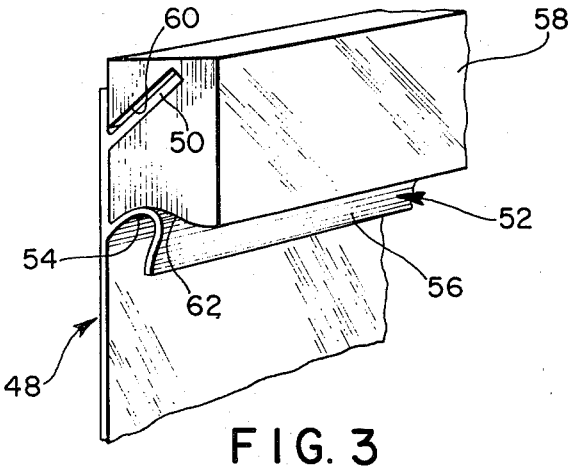
FIG. 3 is a fragmentary perspective view showing a modified form of my invention.

FIG. 3 illustrates a slightly different embodiment of my invention, it being noted that the card 48 is provided with a rearwardly extending upper flange 50 that embodies a straight upward inclination. Lower flange 52 comprises an arcuate upper portion 54 which merges with downwardly depending portion 56. Bar 58 in this form of my invention includes a straight, upwardly inclined slot 60 which receives flange 50, as illustrated; while the bottom surface of bar 58 is concavely curved as at 62. As will be obvious, arcuate portion 54 of lower flange 52 snugly seats within concave curvature 62 to resiliently grip the bar 58. Here again, the card 48 may be snap-mounted on bar 58 and quickly detached therefrom by the proper outward pull. As in the form of my invention illustrated in FIG. 1, card 48 is slidable with respect to bar 58 and may, if desired, be slidably mounted thereon and removed therefrom, assuming, of course, that the bar 58 has an exposed end to permit such slidable attachment and detachment.

Figure 4:
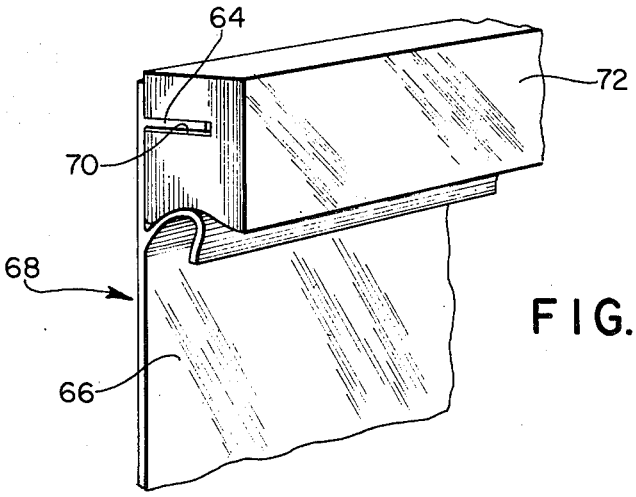
FIG. 4 is a fragmentary perspective view showing a further modification of my invention.

The form of my invention illustrated in FIG. 4 is identical to the form illustrated in FIG. 3, with the single exception that upper flange 64 extends rearwardly in a plane substantially perpendicular to that of the surface 66 of card 68. Slot 70 in bar 72 likewise extends rearwardly in a plane perpendicular to the front surface of the bar in order to receive flange 64. In all other respects the structure and operation of the form of my invention illustrated in FIG. 4 is identical to the embodiment of FIG. 3.

Figure 5:
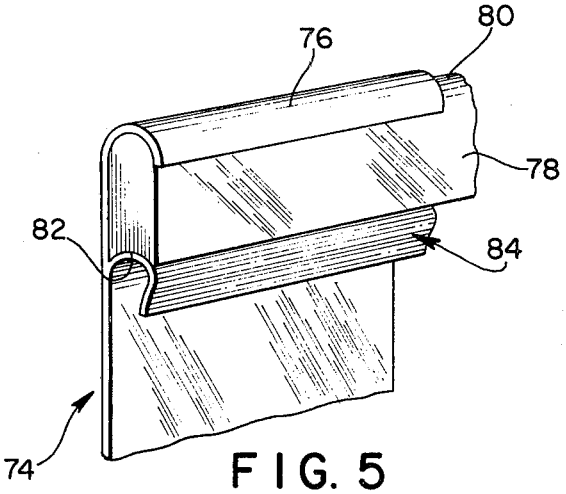
FIG. 5 is a fragmentary perspective view showing still another form of the invention.

FIG. 5 illustrates a somewhat different form of my invention wherein card 74 is provided with a rearwardly extending portion 76 at its top edge, said portion 76 being gently curved so as to snugly receive the top edge of bar 78 which is provided with a corresponding curvature, as illustrated at 80. Bottom surface 82 of bar 78 is provided with a concave curvature adapted to cooperate with rearwardly extending flange 84 integrally carried by card 74, it being understood that the flange 84 corresponds identically to flange 52 illustrated in FIG. 3. In this particular form of my invention, the bar is not provided with any slot; but rather flanges 76 and 84 of card 74 snap-receive bar 78 therebetween, as clearly illustrated.

It will be understood that in the forms of my invention illustrated in FIGS. 3, 4 and 5, the lower flange carried by the card is adapted to snap-receive a conventional mounting bar, such as the bar 46 in FIG. 2, if such should become necessary or desirable.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A display card holder assembly comprising in combination a display card constructed of a flexible plastic material, said card having a flat front surface adapted to receive thereon an article to be displayed, first flange means extending rearwardly from said card having substantially smooth and uninterrupted opposed surfaces, said first flange means being located adjacent to but spaced from the top edge of said card and extending transversely of the card, said first flange means including a first portion that is joined to said card in substantially perpendicular relation and a second portion that is joined to said first portion and that extends upwardly and rearwardly in a generally curvilinear manner, second flange means extending rearwardly of said card in generally perpendicular relation thereto for at least a portion thereof and spaced below said first flange means, the combination further comprising an elongated horizontal bar that releasably and slidably receives said card for display thereon, said bar having a substantially flat front surface, a longitudinal slot in said bar extending inwardly from said front surface, said slot being shaped and dimensioned for conforming to said first flange means so as to freely and releasably receive said first flange means therein, and the distance between said slot and the bottom of said bar being substantially equal to the spacing between said first and second flange means, whereby when said first flange means is positioned in said slot, said second flange means grippingly engages the bottom of said bar to releasably and slidably maintain said card assembled to said bar, with the rear surface of said card in abutting relation to the front surface of said bar, and with the portion of said card located below said second flange means depending below said bar.

2. In the assembly of claim 1, said second flange means extending rearwardly and then downwardly to define an elongated clip adapted to snap-receive an elongated rod therein.

* * * * *